United States Patent [19]

Minor et al.

[11] Patent Number: 4,461,100

[45] Date of Patent: Jul. 24, 1984

[54] DRIVER'S HEEL PROTECTOR

[76] Inventors: Ira L. Minor; Barbara A. Noey, both of 669 E. 84th St., Chicago, Ill. 60619

[21] Appl. No.: 500,409

[22] Filed: Jun. 2, 1983

[51] Int. Cl.[3] ..... A43B 13/22

[52] U.S. Cl. ..... 36/72 B

[58] Field of Search ..... 36/72 B, 71.5, 83, 72 R

[56] References Cited

U.S. PATENT DOCUMENTS

| | | | |
|---|---|---|---|
| 1,820,679 | 8/1931 | Sawyer | 36/72 B |
| 3,104,479 | 9/1963 | D'Amico | 36/72 B |

FOREIGN PATENT DOCUMENTS

| | | | |
|---|---|---|---|
| 34820 | 10/1908 | Austria | 36/72 B |
| 640664 | 4/1928 | France | 36/72 B |
| 35233 | 7/1929 | France | 36/72 B |

*Primary Examiner*—Werner H. Schroeder
*Assistant Examiner*—Tracy Graveline

[57] ABSTRACT

This device is a driver's heel protector, including a flexible shield for placement against a rear end of a shoe, and straps attached to the shield for securement to a lower portion of the shoe and also around a wearer's ankle.

1 Claim, 8 Drawing Figures

12
15
10
14
21
20
11
16

2
2
10
12

15
18
19
13

14
17

18
31

32
19

15

23
22

22

15
23

22

18
15
15
19
13
14

15
25

29
26
27
30
26
28
29

DRIVER'S HEEL PROTECTOR

This invention relates generally to motorists' accessories. More specifically, it relates to an automobile driver's shoe heel shield.

It is generally well known to most automobile drivers that a heel of a shoe applied against the automobile accelerator (or brake) pedal soon becomes scuffed and scratched because of the back of the heel rubbing, a great deal of the time, against the floor carpet, where most of the grit and dirt from the shoe gets lodged in the carpet fibers, so that the shoe quickly becomes looking worn and old. This is particularly objectionable to persons who are fastidious in their attire and appearance. In low slung modern racy cars, such as appeal especially to younger persons, this situation becomes more aggravated, because the driver's leg is still more parallel to the vehicle floor, so that the back of the heel is always resting against the floor. While both men's and women's shoes are thus subject to becoming scuffed, a woman's heel is more exposed to view when being worn in public, so that she is particularly concerned. This situation is objectionable, and is, therefore, in need of an improvement.

Accordingly, it is a principal object of the present invention to provide a protective device, which can be quickly and easily fitted behind a shoe heel, so as to shield it from being scuffed when driving an automobile.

Another object is to provide a driver's heel protector, which is small and flexible, so that it can be conveniently stored in a car glove compartment, or carried in a purse or pocket.

Other objects are to provide a driver's heel protector, which is simple in design, inexpensive to manufacture, rugged in construction, easy to use, and efficient in operation.

These and other objects, will be readily evident, upon a study of the following specification, and the accompanying drawing, wherein.

Figure 8:
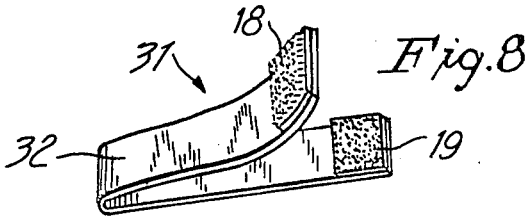
Figure 7:
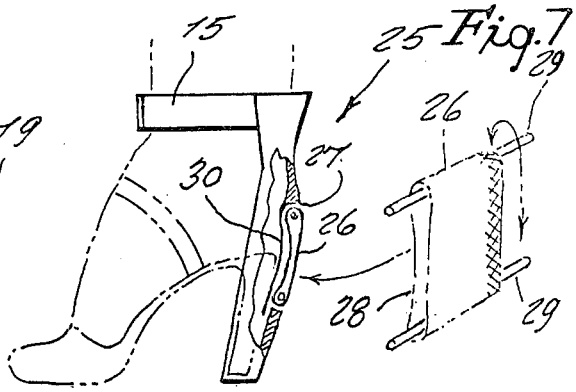

FIG. 7 is a side cross-sectional view of yet another design of the invention, which includes an adjustable pad for selectively hiding a dirt-smudged rear area of the protector, and showing only a clean surface, so that the lady can step out of the car and into public view, without removing the protector, feeling secure that she looks neat; and FIG. 8 is a perspective view of an extra strap accessory for protecting boots being worn by a driver.

Figure 2:
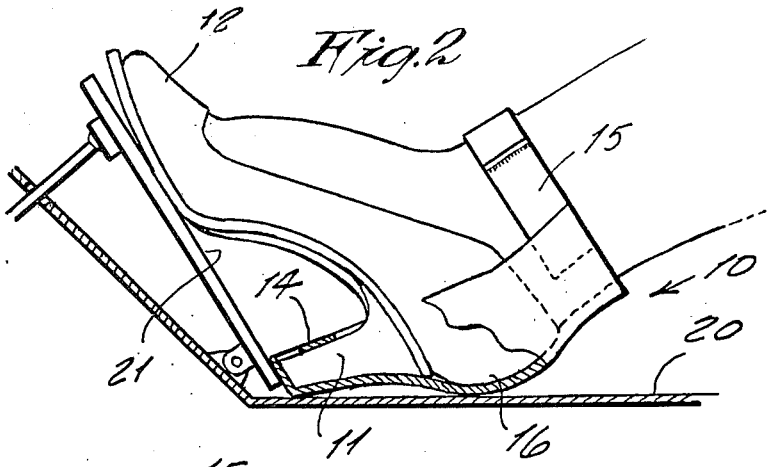
FIG. 2 is a side cross-sectional view thereof, taken on line 2—2 of FIG. 1, and shown in operative use, while a wearer depresses an automobile accelerator pedal by a foot.
Figure 1:
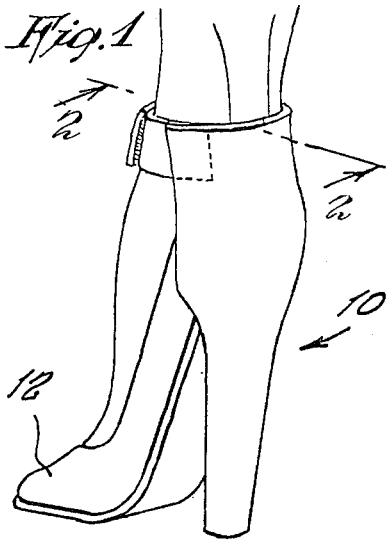
FIG. 1 is a rear perspective view of one design of the invention, made for a lady's high heeled shoe, shown installed thereupon.
Figure 3:
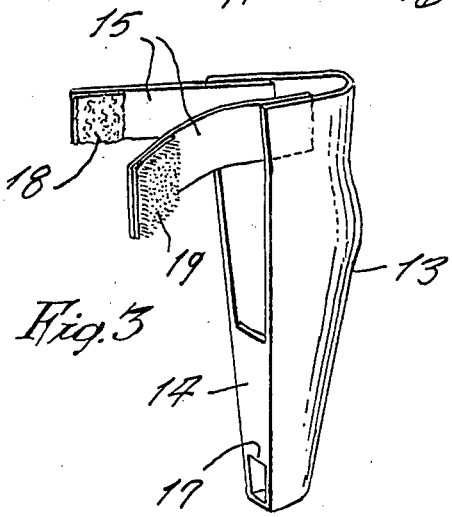
FIG. 3 is a front perspective view of the device, shown per se.

Referring now to the drawing in greater detail, and particularly to FIGS. 1 to 3 thereof, at this time, the reference numeral 10 represents a driver's heel protector, which is designed for fitting a high heel 11 of a lady's shoe 12. It includes a shield 13 for placement against a rear side of the heel, a fixed lower strap 14 for fitting around a front side of the heel, and an adjustable upper strap 15 for securement around a wearer's ankle. The shield is made from either a flexible leather, vinyl or fabric material that will readily contour to the shape of the heel, and also to a back end 16 of the shoe upper. The strap 14 comprises an elastic band made of rubber, or the like, and which, along each side edge, is permanently attached to the shield. A small hole 17 therebeneath allows rain water to run out, in case a person has stepped in a puddle. The strap 15 is made from two elastic bands permanently attached at one end to the shield, and are adjustably secured together at their other end by means of velcro loop pile strips 18 and 19.

In use, as shown in FIG. 2, the shield protects the heel from rubbing against a carpet or floor 20 of the automobile, when the foot is applied against the pedal 21.

Figure 5:
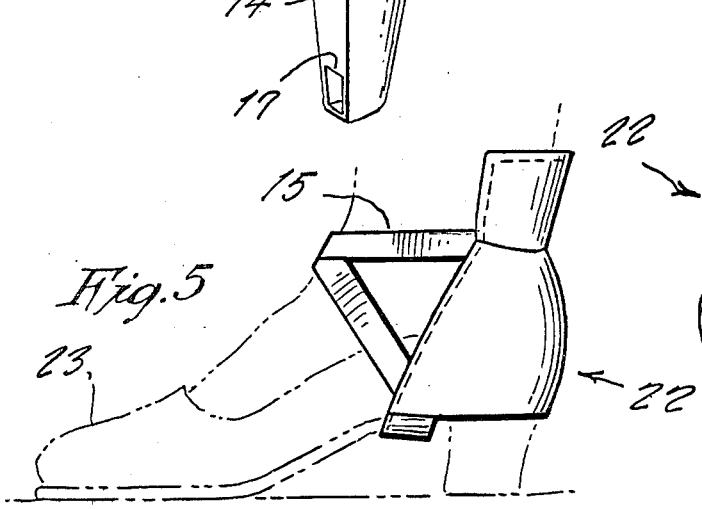
FIG. 5 is a side elevation view thereof.
Figure 4:
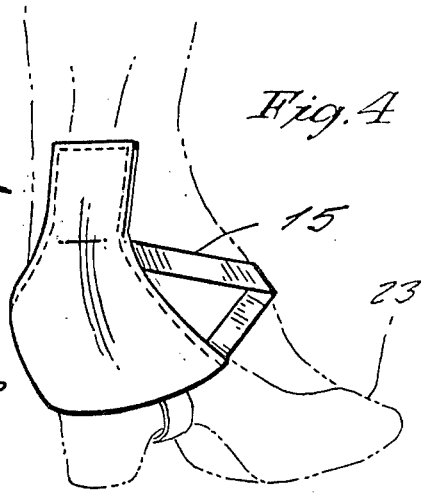
FIG. 4 is a rear perspective view of another design of the invention, made of a lady's low heeled shoe, shown being worn thereupon.
Figure 6:
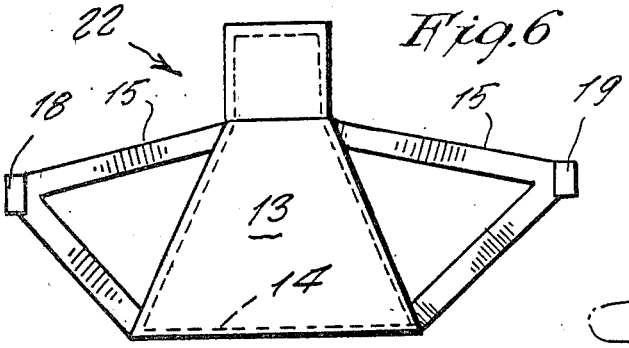
FIG. 6 is a rear elevation view of the device, shown per se, and spread open.

Referring now to FIGS. 4, 5 and 6, a driver's heel protector 22 is shown, that is designed for a lady's low heeled shoe 23. It is made generally the same as the protector 10, with the same kind of components of the same kind of materials, even though they may be differently-shaped, in order to accommodate the different shape of the shoe. Thus, in this design, the shield may not extend downward more than protecting only the rear of the shoe, and not the heel therebeneath, as shown. Also, the shield may extend much higher above the shoe, as shown. The lower strap 14 is under the foot arch 24, rather than around the heel, and the upper strap 15 is differently styled. But it still accomplishes the same purpose of protecting that portion of a shoe which may get scuffed, when driving an automobile.

Referring now to FIG. 7, still another design of driver's heel protector 25 is shown, and which is the same as the driver's heel protector 10, except that it additionally includes a pad 26 in a rear opening 27 thereof, the pad being flush with the rear side of the shield, and being located to receive most of the worst scuffing. The pad is made as an endless roll 28, that is rollable around a pair of spaced-apart pins 29 secured to the shield, so that a clean surface portion of the pad may be exposed, after another portion has become scuffed or soiled, thus allowing a lady to expose the scuffed portion while driving, and exposing the clean portion thereof when stepping out of the car, such as when stopping at a restaurant while traveling. The rollable pad is, accordingly, made of a flexible material, and may have the same textured surface and color as the rest of the protector. A flap 30 of the protector, located behind the pad, protects the shoe surface from the soiled, scuffed side of the pad.

In FIG. 8, an extra strap accessory 31 is shown, for securing an upper portion of a boot, by wrapping it snugly around the wearer's leg, so that it does not hang limp, and wipe on the vehicle floor. It includes an elastic band 32, having velcro loop pile strips 18 and 19 on its end. This strap may be made attachable to the protectors described above.

While various changes may be made in the detail construction, it is understood that such changes will be within the spirit and scope of the present invention, as is defined by the appended claims.

What we now claim is:

1. A driver's heel protector, comprising, in combination, a shield for placement against the rear of a shoe, a lower strap for securing the lower portion of said shield to said shoe, and an upper strap for securement of the upper portion of said shield to said shoe; said shield being made from a flexible material, so as to conform to the contour of said shoe rear, and said straps being made from elastic; co-operative loop pile strips being provided on said upper strap for adjustability of length thereof; and an opening in the rear of said shield and a pad in said opening having a rear side that is flush with a rear side of said shield, said pad comprising a flexible, endless pad material rotatably mounted around a pair of spaced-apart pins secured to said shield, and means being provided to prevent said pad from rubbing against the surface of said shoe.

* * * * *